United States Patent [19]

Hirakawa et al.

[11] Patent Number: 4,460,135

[45] Date of Patent: Jul. 17, 1984

[54] MILL ROLL STAND

[75] Inventors: Tadashi Hirakawa; Hiroshi Sato, both of Mihara, Japan

[73] Assignee: Mitsubishi Jukogyo Kabushiki Kaisha, Japan

[21] Appl. No.: 376,193

[22] Filed: May 7, 1982

[30] Foreign Application Priority Data

May 9, 1981 [JP] Japan ..... 56/69939

[51] Int. Cl.[3] ..... B65H 19/02

[52] U.S. Cl. ..... 242/68.4; 414/911

[58] Field of Search ..... 242/68.4, 58.6, 68, 242/86.5 R, 58.2, 86.52; 414/911, 664, 667, 619, 621, 729

[56] References Cited

U.S. PATENT DOCUMENTS

| | | | |
|---|---|---|---|
| 2,561,146 | 7/1951 | Sieg | 242/58.6 |
| 2,622,816 | 12/1952 | Koch | 242/58.6 |
| 3,276,711 | 10/1966 | Martin | 242/58.6 |
| 3,321,147 | 5/1967 | Martin | 242/58.6 |
| 3,743,198 | 7/1973 | Lucas | 242/58.6 |

*Primary Examiner*—Stuart S. Levy
*Assistant Examiner*—Scott J. Haugland
*Attorney, Agent, or Firm*—McGlew and Tuttle

[57] ABSTRACT

A mill roll stand comprises a stationary frame fixed to the floor, a pair of movable frames so attached to the fixed frame as to move freely in the direction of width of the fixed frame, arms having one end thereof pivotally supported by the movable frames and the other end fitted with a member for engagement with a paper roll and a driving device attached to the movable frames respectively for swinging of the arms respectively.

4 Claims, 7 Drawing Figures

MILL ROLL STAND

FIELD AND BACKGROUND OF THE INVENTION

The present invention relates to an improved mill roll stand.

A conventional mill roll stand, for example, is illustrated in FIG. 1 (in the drawing, a showing of the right half of the roll stand is omitted because of its right and left symmetry). In the drawing, a paper roll 1 is supported by arms 2 and 2' at an operating side X and a driving side Y and these arms 2 and 2' are inserted onto a key fixed-cross shaft 3. The arms are prevented from rotating between themselves and the cross shaft 3 but are adapted to slide freely in the axial direction.

This cross shaft 3 has both ends rotatably supported by frames 4 and 4' at the driving side Y and the operating side X of the apparatus respectively. Also, a lever 5 is secured to the driving side Y of the cross shaft 3 and the other end of the lever 5 is connected to a piston rod 7 of an up and down cylinder 6 having its head side secured to the frame 4.

Also, a threaded shaft 8 is rotatably attached to the cross shaft 3 in parallel, the arms 2 and 2' are arranged in threaded engagement with the threaded arm 8 and a motor 9 is directly connected to the driving side Y.

The threaded shaft 8 is formed with right and left opposite threads at the driving side Y and the operating side X, so that the arms 2 and 2' come mutually closer or are separated from each other, depending on the direction of rotation of the motor 9, whereby it is made possible to chuck the paper roll 1, and it is made possible to rise and lower the paper roll 1 by rotating the lever 5 due to the actuation of the lift cylinder 6.

However, in the case of a conventional roll stand of the aforesaid structure for causing the cross shaft 3 to hold up the paper roll 1, which can be as heavy as the maximum weight, of 4 tons, it is necessary for the roll stand to withstand bending moment and twisting moment due to the weight of the paper roll 1. For this purpose, it has heretofore been customary that large rigidity of the roll stand is required and moreover, the frames 4 and 4' and the arms 2 and 2' should be correspondingly rigid. Accordingly, the mass of the arms 2 and 2' and the cross shaft 3 should be increased so much that power necessary for actuation becomes large until it becomes difficult to speed up such actuation and it becomes also costly. These are unavoidable drawbacks inherent in the conventional mill roll stand.

SUMMARY OF THE INVENTION

Therefore, the object of the present invention resides in eliminating all the aforegoing drawbacks. Namely, according to the present invention, the mill roll stand consists of a stationary frame secured to the floor, a pair of movable frames so attached to said fixed frame as to move freely in the direction of width thereof, arms having their ends pivotally supported by said movable frames and their other ends fitted with a member for engagement with a paper roll and driving means attached to the movable frames for swinging said arms.

According to the present invention, therefore, it is possible to do with a necessary minimum of parts for opening, closing, raising or lowering the mill roll stand and thereby to provide such mill roll stand as is capable of speedy actuation at low cost.

All the other objects and characteristics of the invention will become more apparent from the following description with reference to certain preferred embodiments hereinafter.

DESCRIPTION OF THE PREFERRED EMBODIMENTS

Figure 2:
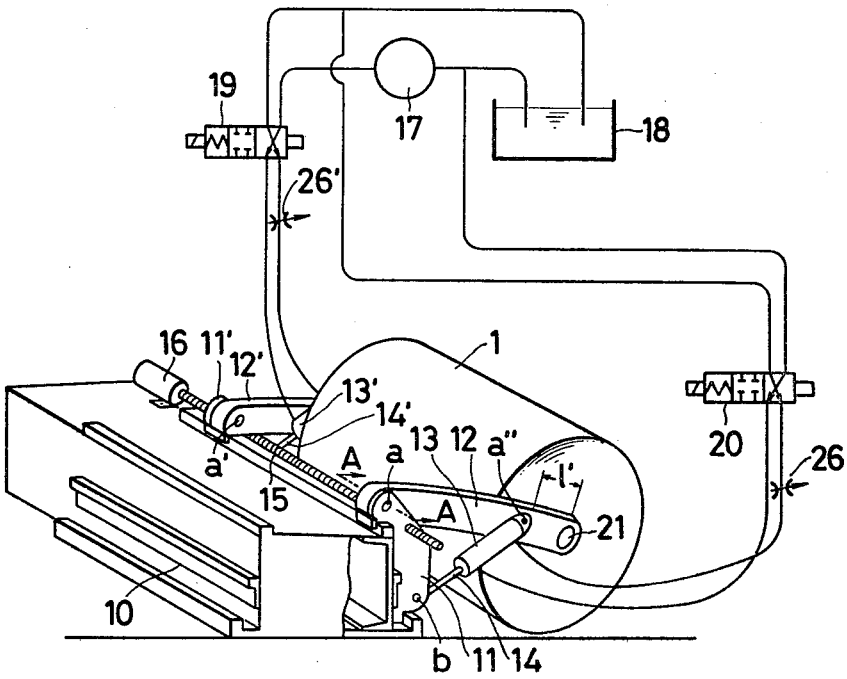
FIG. 2 is a perspective view showing a preferred embodiment of the mill roll stand of the present invention.

In FIG. 2, the left half of the mill roll stand is omitted in the illustration because it is arranged right and left symmetrically with what is shown in the drawing. In the drawing, a frame 10 has a cross section as shown, forming an integral body over both the driving side and the operating side and its bottom surface over the whole width is secured to the floor surface.

Numerals 11 and 11' indicate movable frames and arms 12 and 12' are up and down rotatable around shafts a and a' in the centers, their respective top ends being adapted to support a paper roll 1. Other support points b and another one on the other side (not shown) of the movable frames 11 and 11' and the arms 12 and 12' are connected together by means of cylinders 13 and 13' and piston rods 14 and 14'. Also, the movable frames 11 and 11' are connected together by being threadably received onto a threaded shaft 15 and a motor 16 supported on the frame 10 is directly connected to the end of said threaded shaft 15.

The threaded shaft 15 and the movable frames 11 and 11' are combined by mutually opposite threading means at the driving side and the operating side so that the movable frames can come closer or be separated from each other, depending on the direction of rotation of the motor 16.

The supply and discharge sides of the cylinders 13 and 13' are connected to a pump 17 and a tank 18 through the circuits as shown in the drawing and electromagnetic valves 19 and 20 and flow-amount adjusting valves 26 and 26' are incorporated in said circuits.

Rolling centers 21 and another one on the other side (not shown) of the same structure of conventional type are attached to the arms 12 and 12'.

The rise and fall of the arms 12 and 12' in FIG. 2 are facilitated by extension and contraction of the cylinders 13 and 13'. Namely, when the shift valves 19 and 20 are so shifted as hydraulic or air pressure can be imposed on the head side of the cylinders 13 and 13', the arms 12 and 12' are sure to rise and are lowered down by imposing hydraulic or air pressure on the rod side. Likewise, in order to ensure the same speed of actuation of the arms 12 and 12', flow-amount adjusting valves 26 and 26' will be adjusted accordingly. The separation and approximation of the arms 12 and 12' can be accomplished by rotating the motor 16 in natural or reverse directions respectively. In other words, the rotation of the motor 16 is followed by the rotation of the threaded shaft 15 so that the movable frames 11 and 11' can come closer or be separated from each other whereby it is made possible to open or close them while keeping the arms 12 and 12' attached to the movable frames 11 and 11' and the cylinders 13 and 13' in their rising or falling position. If one of the arms 12 and 12' is to be lifted or lowered, it can be accomplished by shifting either the shift valve 19 or 20 singly.

Figure 4:
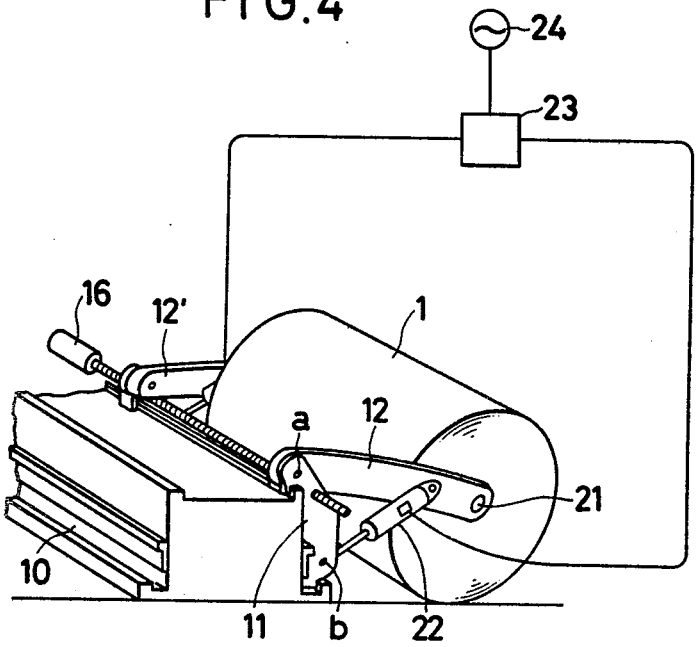
FIG. 4 is a perspective view showing a preferred embodiment different from that of FIG. 2.

As driving means for lifting or lowering the arms 12 and 12', an electric motor may be used as shown in FIG. 4. In the drawing, numeral 22 indicates a motor cylinder of a well-known type which is capable of extending or retracting its rod by an electric motor. Numeral 23 designates a control board and 24 an electric source shown in the drawing.

Figure 5:
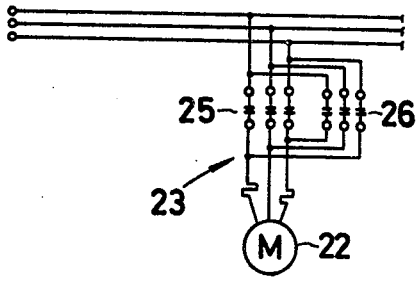
FIG. 5 is a circuit diagram of a control board black shown in FIG. 4.

The system of wiring in the control board 23, as shown in FIG. 5, is such that "O" and "Off" of electromagnetic switch 25 or 26 will lead to the reverse rotation of the electric motor in the motor cylinder 22 but all other effects are identical with those of the preferred embodiment of FIG. 2.

Figure 6:
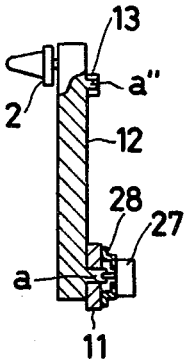
FIG. 6 is a cross-sectional view, taken along line A–A of FIG. 2, showing an example of control means for synchronizing the rise and fall of arms.
Figure 7:
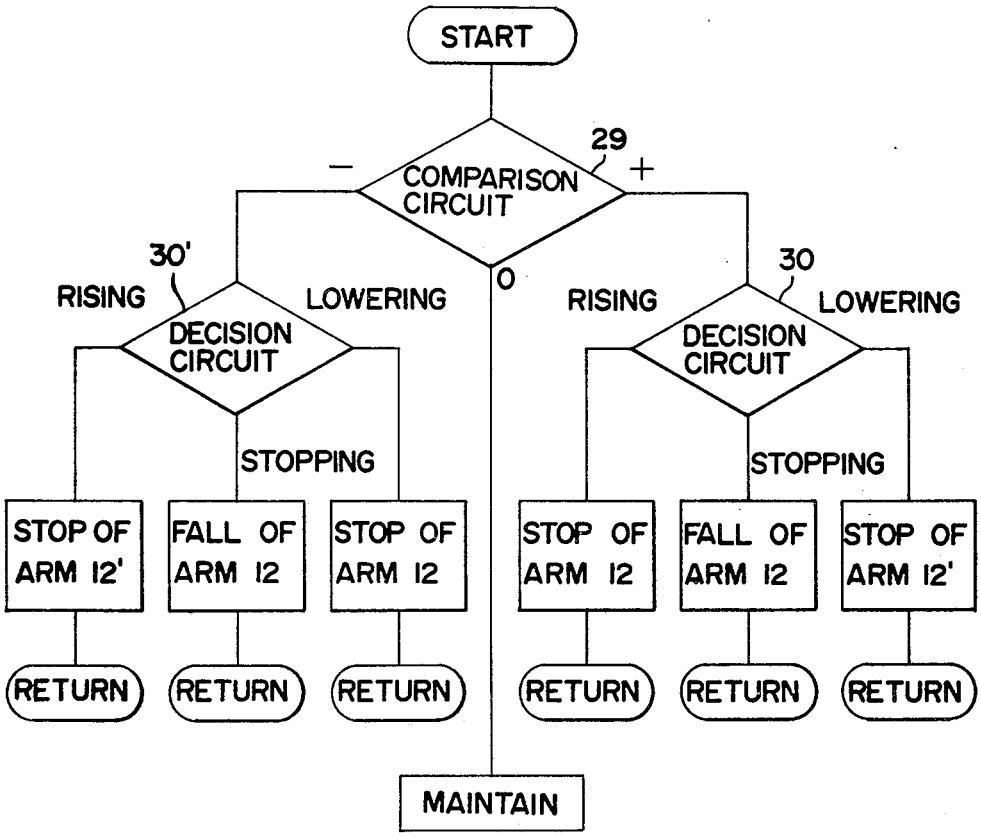
FIG. 7 is an explanatory view showing a control operation of a control circuit.

In FIGS. 6 and 7, there is shown an example of control method for synchronizing the rise and fall of the arms 12 and 12'. By the way, FIG. 6 is a cross-sectional view taken along line A–A of FIG. 2. In FIG. 6, numeral 27 designates a potentiometer, the shaft of which can be rotated for the angle of rotation of the shaft a of the arm 12. The potentiometer 27 is attached to the movable frame 11 by means of a bracket 28. Meanwhile, another potentiometer on the other side, which is not shown in the drawing is also provided.

FIG. 7 shows a control circuit. In the drawing, numeral 29 is a comparison circuit which is designed to compare generated voltage of the potentiometer 27' at the driving side and generated voltage of the potentiometer 27 at the operating side (driving side as a standard) in terms of voltage generated in proportion to the angle of rotation of the potentiometer (angle of rotation of the arm).

To begin with, when said both voltages are the same, the signal is maintained as it is. When the one voltage is smaller than the other the signal is transferred to a decision circuit 30'. This decision circuit 30' has the function of determining whether both the arms are rising, lowering or stopping. Accordingly, in the case of rise of the arms, the electromagnetic shift valve for the arm at the operating side (designated as 20 in FIG. 2) is shifted to a stop. In the case of its lowering, the electro-magnetic shift valve for the arm at the driving side (designated as 19 in FIG. 2) is shifted to a stop. In the case of stopping, the electromagnetic shift valve 19 is shifted to the side of rise of the arm.

On the other hand, when said one voltage is larger than the other, the signal is shifted to the dicision circuit 30 so as to instruct the action as shown in FIG. 7 in like manner. After this instruction of action, the comparison circuit again serves to compare the angles of rotation of the potentiometers 27 and the other one (not shown) of the arms at the operating and driving sides, namely, it serves to compare the difference in the angle of rotation of the arms at the operating and driving sides and the same action is repeated until such difference disappears, thereby permitting synchronous control of the arms. If they are not to be synchronized, they may be raised or lowered individually without synchronization.

Figure 1:
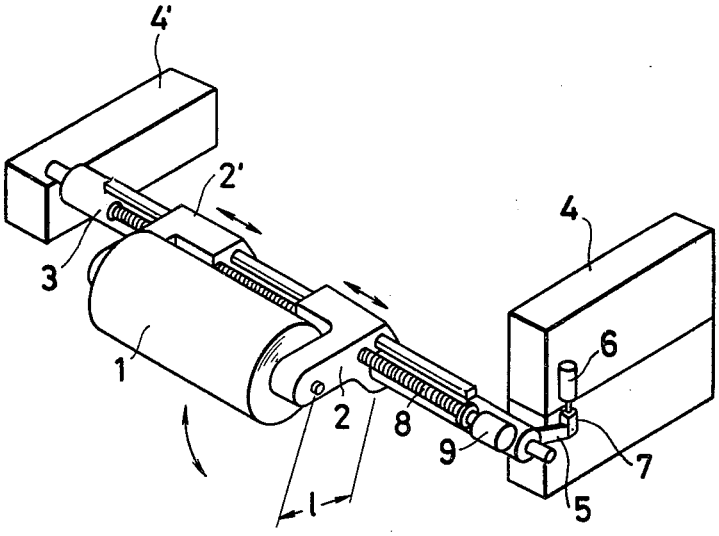
FIG. 1 is a perspective view showing the left half of a conventional mill roll stand.

As explained in detail hereinbefore, according to the present invention, it is possible to secure the bottom surface of the frame to the floor surface over the entire width of the frame, so that a paper roll can be supported by the aforesaid structure of rigidity less than a cross shaft supporting both ends only. Also, according to a conventional mill roll stand, such moment as (weight of paper roll)×(length of arm) (size l in FIG. 1) is imposed on the arm, while the arm of the mill roll stand of the present invention is supported by a support point a" near the paper roll by driving means, so that the moment on the arm may occur as a moment of (weight of paper roll)×(distance between support points) (size l' in FIG. 2) thus presenting itself as a structure of size smaller than a conventional one and making its rigidity smaller than that of the latter.

As a consequence, the mass of the frame and arm can be reduced and at the same time, owing to the small mass of the arm, it is possible to speed up the rise and fall of the arm and its opening and closing action and to shorten the time cycle of operation. Moreover, since the right and left arms can be lifted or lowered respectively individually by the operation of electromagnetic valves, it is possible to make a difference in the tensile strength of the wound-release sheet uniform at the operating side and the driving side of the sheet by making the heights of the paper roll different from each other at the operating side and the driving side.

Figure 3:
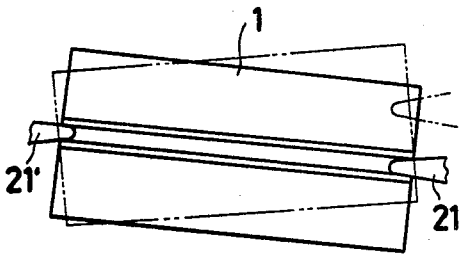
FIG. 3 is a diagrammatical view showing the withdrawal of a paper roll from rolling centers.

In addition, after the paper roll has been used up and when the remaining paper roll is to be removed from the rolling centers, there usually occurs such trouble as one side only is withdrawn and the opposite side remains in a conventional case, while the present invention makes it easy to withdraw the used or remaining paper roll from the rolling centers by opening the arms while swinging them shown by a full line and a dotted chain line in FIG. 3.

At the same time, in the case of discharging the paper roll removed from the rolling centers, it is possible to elevate the arm only at the side of discharge. (namely, the rise of the opposite arm is dispensed with.) In the case of charging a paper roll, the arm only at the charging side may be elevated so that a small amount of actuating oil will do instead of the elevation of the arms at both sides and also because of half weight of the rising arm, its shock is insignificant and it becomes also possible to move the arms in combination with the effect of quickening the aforesaid rise and fall and opening and closing action of the arms. Accordingly, it is also possible to reduce a period of time necessary for replacement of paper rolls (discharge of old paper rolls, charging of fresh paper rolls or mounting) to a large extent.

What is claimed is:

1. A mill roll stand to be supported on a floor, comprising:

a stationary frame secured to the floor and shaped to be supported across a width thereof by the floor;

a pair of movable frames attached to said stationary frame so as to move in the direction of the width of said stationary frame;

a pair of arms having one end pivotally supported by one of said movable frames and the other end fitted with a member for engagement with a paper roll;

driving means attached to said movable frames for swinging said arms;

control means for controlling said driving means; and further means attached to said control means for actuating said driving means both at the same time and individually.

2. A mill roll stand, as claimed in claim 1, wherein said driving means comprise a pair of fluid-pressure cylinders connected to said pair of arms and said control means comprise a pair of flow-passage shift valves disposed in fluid pipe arrangements of said fluid-pressure cylinders so that said driving means can be controlled by means of said control means.

3. A mill roll stand, as claimed in claim 1, wherein said driving means comprises a pair of cylinders connected to said pair of arms, each cylinder having a rod and an electric motor for extension and retraction of said rod by means of said electric motor, and said control means comprises an electric circuit for rotating said electric motor in a reverse manner.

4. A mill roll stand, as claimed in claim 1, wherein said further means comprises a synchronizing control circuit for detecting the rotational position of each of said arms and driving said arms in such a manner that no difference occurs between both detected rotational positions of said arms.

* * * * *